US006254417B1

(12) United States Patent
Pan

(10) Patent No.: US 6,254,417 B1
(45) Date of Patent: Jul. 3, 2001

(54) I/O CONNECTOR FOR A PORTABLE COMMUNICATIONS DEVICE

(75) Inventor: Long-Jyh Pan, Taipei Hsien (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/620,226

(22) Filed: Jul. 20, 2000

(51) Int. Cl.[7] ..... H01R 13/627
(52) U.S. Cl. ..... 439/350; 439/357
(58) Field of Search ..... 439/296, 299, 439/310, 345, 350, 370, 357

(56) References Cited

U.S. PATENT DOCUMENTS 3,639,950 * 2/1972 Lutz et al. ..... 24/615
5,088,932 * 2/1992 Nakamura ..... 439/350
5,167,523 * 12/1992 Crimmins et al. ..... 439/350
5,201,669 * 4/1993 Lin ..... 439/357
5,971,790 * 10/1999 Rohde ..... 439/357

* cited by examiner

*Primary Examiner*—Tulsidas Patel
(74) *Attorney, Agent, or Firm*—Winston Hsu

(57) ABSTRACT

An I/O connector has a housing with front, rear and top openings. Set within the housing is a monolithically formed latch. This latch has first and second tines. The first tine has a notch at its front end for engaging with an appropriate locking niche on the portable communications device, and a button at its back end. The button protrudes through the top opening of the housing, and the front ends of the tines protrude through the front opening of the housing. By pressing on the button, the first tine is depressed towards the second tine, which unlocks the I/O connector from the locking niche. The second tine is slightly longer than the first tine to ensure that the first tine stays locked within the locking niche.

10 Claims, 6 Drawing Sheets

I/O CONNECTOR FOR A PORTABLE COMMUNICATIONS DEVICE

BACKGROUND OF THE INVENTION

1. Field of the Invention

The present invention relates to an input/output (I/O) connector for a portable communications device. More specifically, the present invention discloses an I/O connector that more securely attaches to the portable communications device, and which is easier to detach.

2. Description of the Prior Art

Portable communications devices, such as cellular telephones, pagers, personal data assistants, etc., have become ubiquitous in recent years. Being portable, such devices frequently need to be charged, or connected to another device, such as a personal computer (PC) to upload or download information. The portable communications device is connected to such an external device via an input/output (I/O) connector. The I/O connector typically snaps onto an I/O port of the portable communications device, and should lock into position so that it does not become unintentionally unplugged from the portable communications device.

Please refer to FIG. 1. FIG. 1 is a perspective view of a prior art I/O connector 10 being inserted into a portable communications device, a cellular telephone 90. The cellular telephone 90 has an I/O interface port 93 that is used to electrically interface the cellular telephone 90 with the I/O connector 10. The I/O interface port 93 has locking niches 92 with which the I/O connector 10 is secured to the cellular telephone 90.

The I/O connector 10 has an upper tine 12 and a lower tine 14 that protrude from a housing 20. These upper and lower tines 12, 14 are inserted into a locking niche 92 when the user attaches the I/O connector 10 to the cellular telephone 90. A notch 11 on the upper tine 12 engages with the locking niche 92 to lock the I/O connector 10 to the cellular telephone 90. The housing 20 of the I/O connector 10 has an upper surface 22. Into this upper surface 22 is a gap 23 that partially subtends a rectangle. This creates an elastic surface 24 that can be pressed downwards. It should be noted that, except for the electrical conductors, the I/O connector 10 is made entirely of plastic.

Please refer to FIG. 2. FIG. 2 is a cross-sectional view of the I/O connector 10 along line 2—2 in FIG. 1. When the elastic surface 24 is pressed downwards in the direction of arrow 26, the underside of the elastic surface 24 presses against a bump 13 on the upper tine 12. Consequently, the upper tine 12 is also pressed downwards in the direction of arrow 26 towards the lower tine 14. In particular, the notch 11 is depressed downwards towards the lower tine 14. This action causes the notch 11 to disengage from the locking niche 92 of the cellular telephone 90, thus unlocking the I/O connector 10 from the cellular telephone 90.

The prior art design for the I/O connector 10, however, does not fasten as securely as would be desired into the locking niche 92. Please refer to FIGS. 3A to 3C. FIGS. 3A to 3C show a side view sequence diagram of the prior art I/O connector 10 being unintentionally detached from the locking niche 92. In FIG. 3A, the notch 11 on the upper tine 12 is seen to be firmly engaged with an upper portion 91 of the locking niche 92. The I/O connector 10 is thus firmly fastened to the cellular telephone 10. In FIG. 3B, the I/O connector 10 undergoes torque 28. The I/O connector 10 thus rotates about the niche 92. This rotation tends to cause the upper and lower tines 12, 14 to squeeze together inside the niche 92. Specifically, the notch 11 can no longer engage properly with the upper portion 91 of the locking niche 92. The I/O connector 10 becomes unintentionally unlocked from the niche 92. Consequently a force 29, as shown in FIG. 3C, is able to remove the I/O connector 10 from the locking niche 92, disconnecting the cellular telephone 90 from an external device.

Furthermore, as shown in FIG. 2, two resisting forces must be overcome for a user to unlock the I/O connector 10. First, the user must press against the resisting force of the elastic surface 24. Secondly, the user must press against the resisting force of the upper and lower tines 12, 14. Together, these two resisting forces may make it unpleasantly difficult for a user to unlock the I/O connector 10 from the portable communications device, i.e., from the cellular telephone 90.

SUMMARY OF THE INVENTION

It is therefore a primary objective of this invention to provide an I/O connector for a portable communications device that firmly locks to the portable communications device, and yet which a user can easily unlock.

The present invention, briefly summarized, discloses an input/output (I/O) connector for a portable communications device. The I/O connector has a housing with front, rear and top openings. Set within the housing is a monolithically formed latch. This latch has first and second tines. The first tine has a notch at its front end for engaging with an appropriate locking niche on the portable communications device, and a button at its back end. The button protrudes through the top opening of the housing, and the front ends of the tines protrude through the front of the housing. By pressing on the button, the first tine is depressed towards the second tine, which unlocks the I/O connector from the locking niche. The second tine is longer than the first tine to ensure that the first tine stays locked within the locking niche.

It is an advantage of the present invention that the second tine prevents the first tine from becoming unintentionally unlocked from the portable communications device, thus ensuring a firm electrical connection between the portable communications device and an external device. Also, because the button protrudes through the housing, a user must only overcome the resisting force of the tines, making it easier for a user to unlock the I/O connector.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
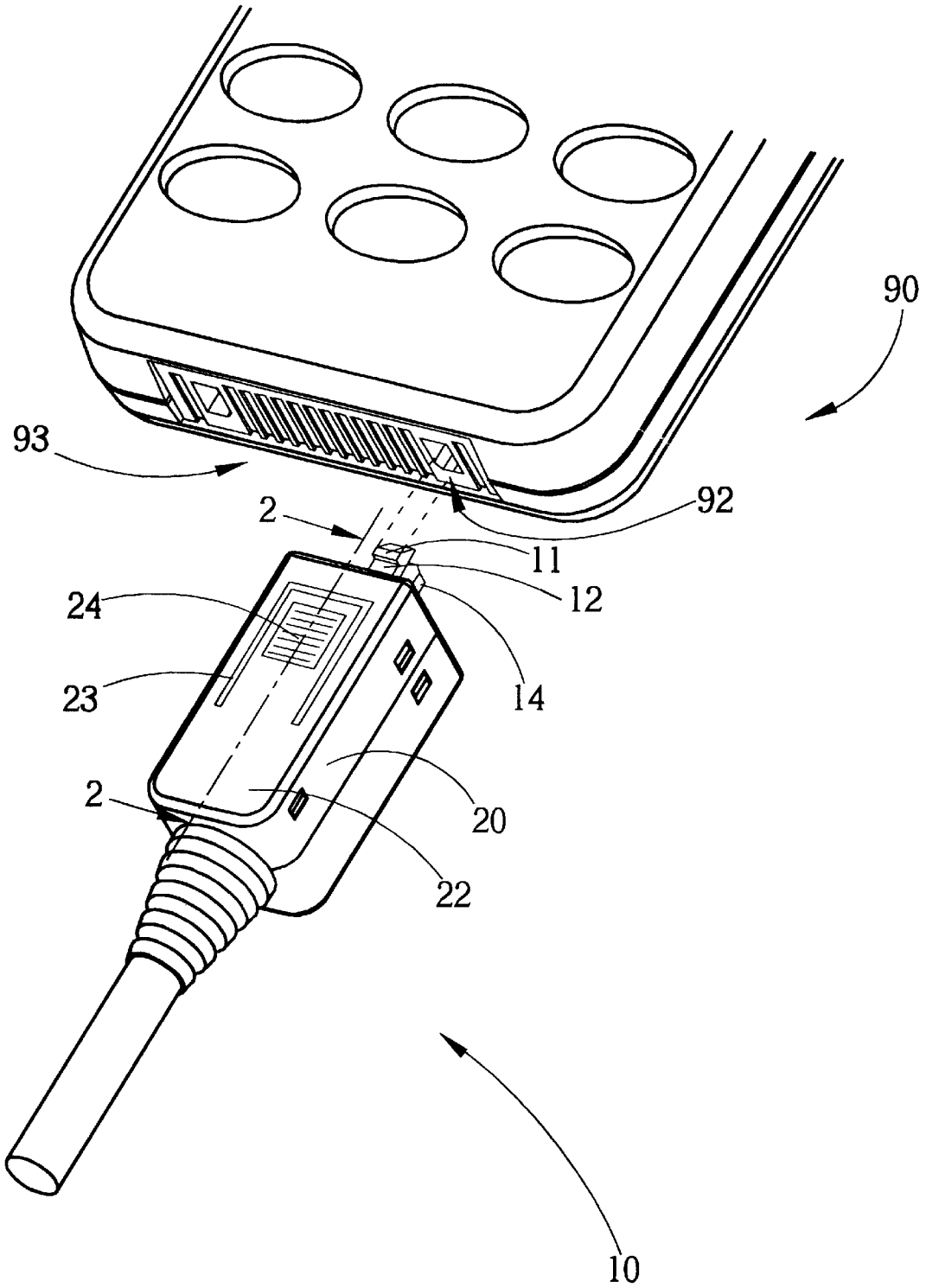
Fig. 1 Prior art
FIG. 1 is a perspective view of a prior art I/O connector being inserted into a portable communications device.
Figure 2:
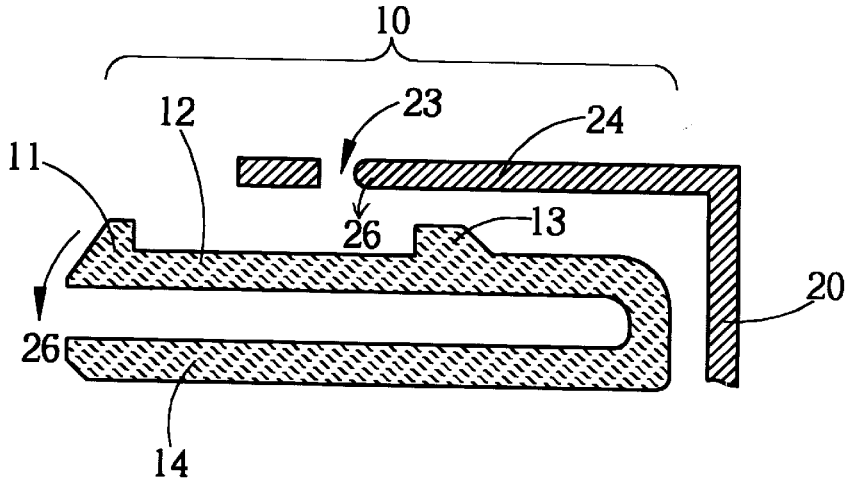
Fig. 2 Prior art
FIG. 2 is a cross-sectional view of the I/O connector along line 2—2 shown in FIG. 1.
Figure 3A:
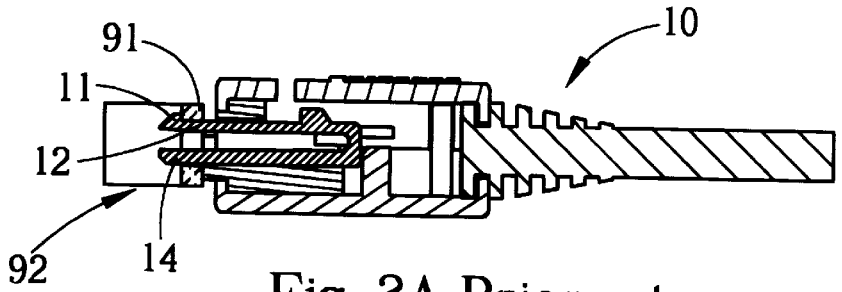
Fig. 3A Prior art
FIGS. 3A to 3C show a side view sequence diagram of the I/O connector being unintentionally detached from the locking niche in FIG. 1.
Figure 3B:
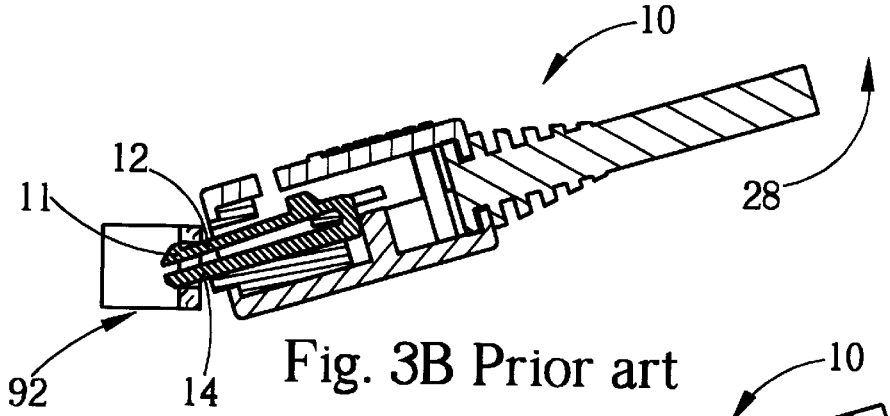
Fig. 3B Prior art
Figure 3C:
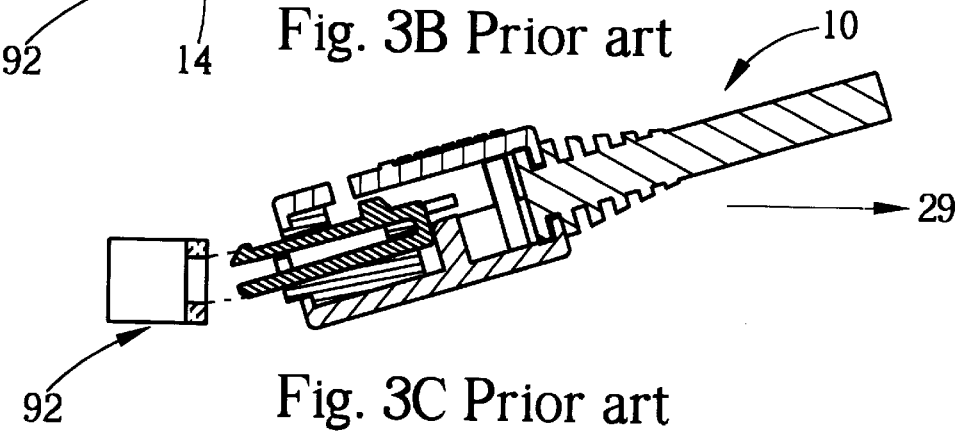
Fig. 3C Prior art
Figure 4:
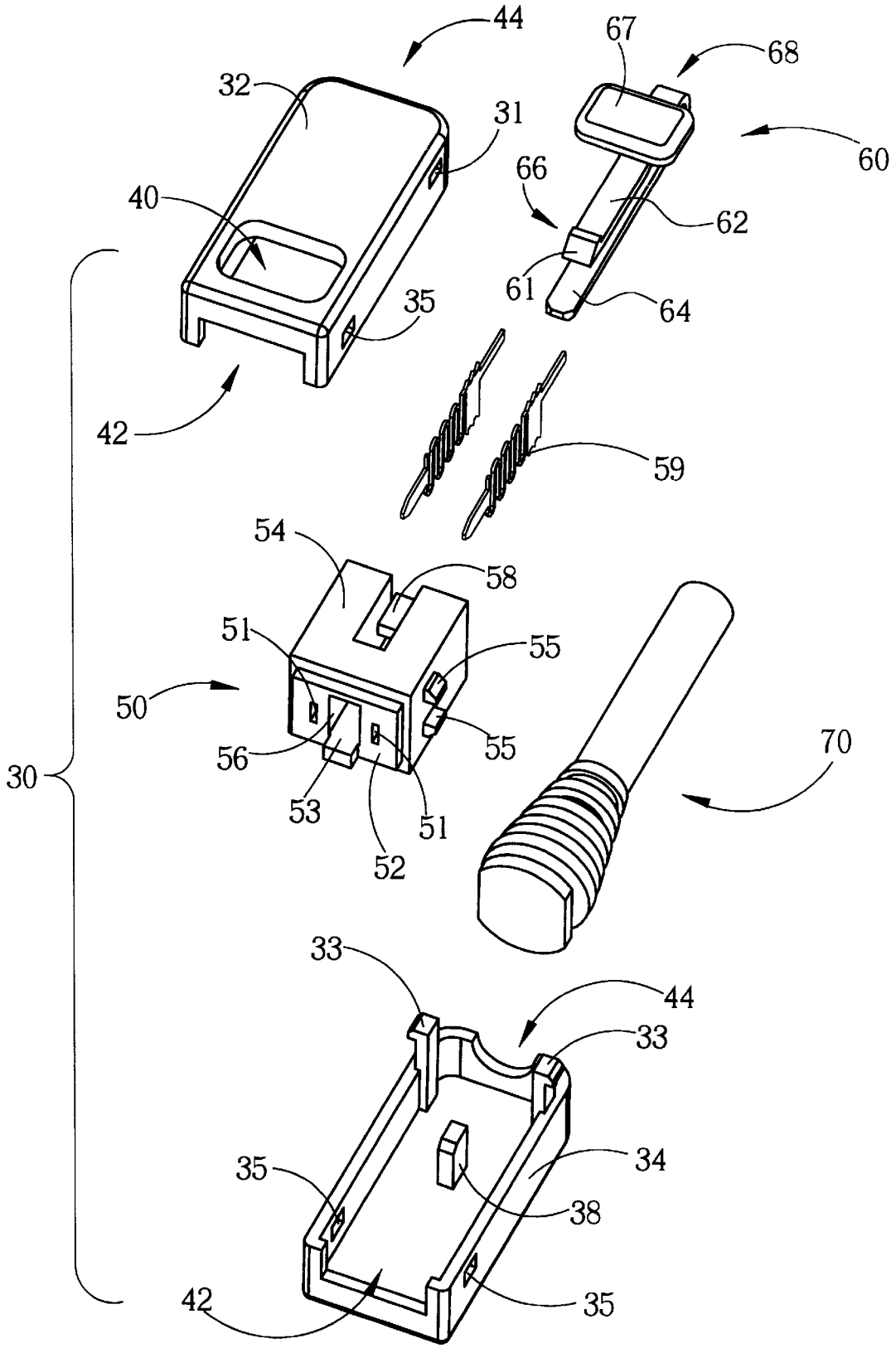
FIG. 4 is an exploded view of an I/O connector for a portable communications device according to the resent invention.
Figure 5:
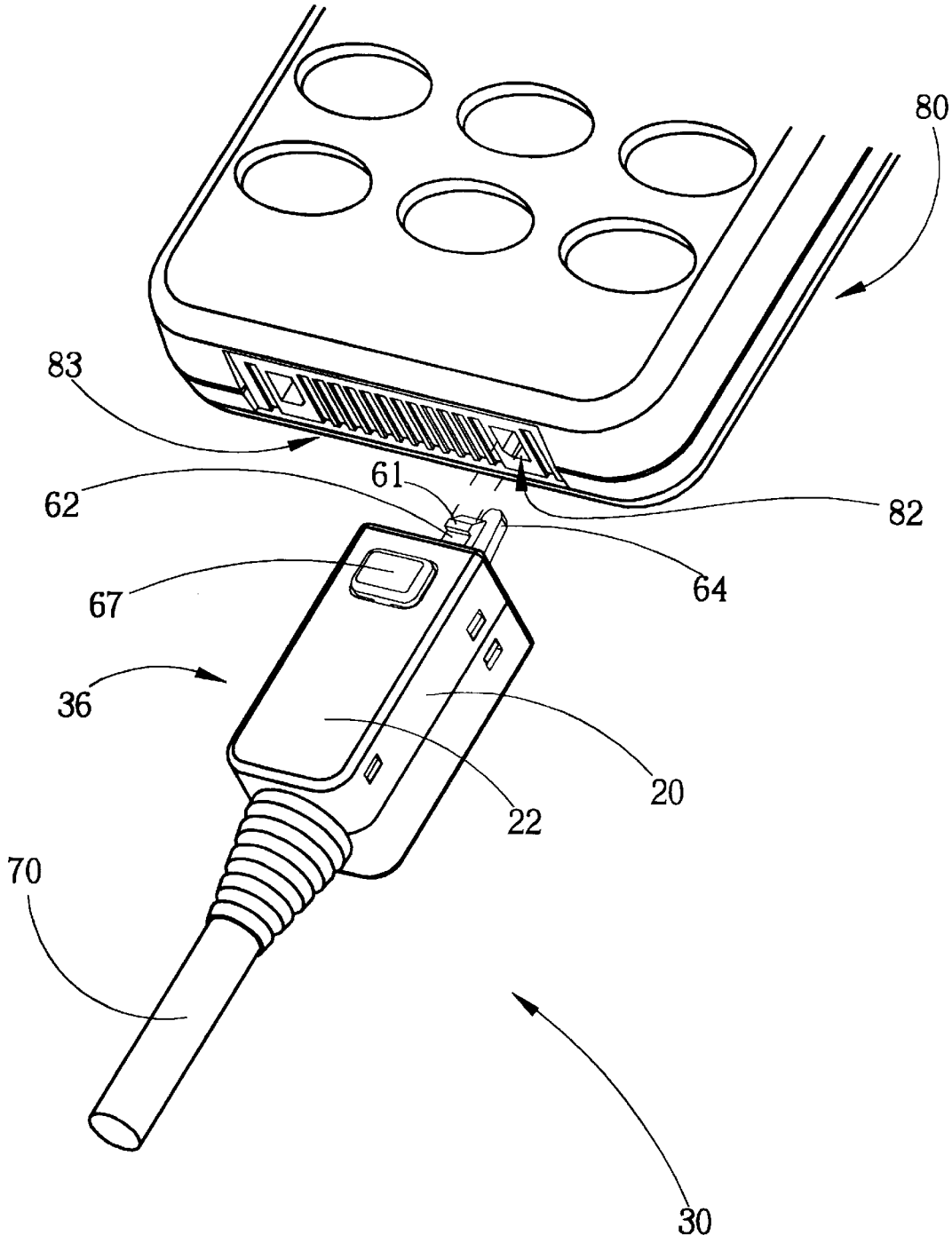
FIG. 5 is a perspective view of the I/O connector in FIG. 4 being inserted into a portable communications device.

Please refer to FIG. 4 and FIG. 5. FIG. 4 is an exploded view of an I/O connector 30 for a portable communications device according to the present invention. FIG. 5 is a perspective view of the I/O connector 30 being inserted into a portable communications device, a cellular telephone 80. For the sake of simplicity, the cellular telephone 80 will be used as an example of a portable communications device throughout this disclosure. However, this should not be construed to mean that the present invention can only be used for cellular telephones. To the contrary, the present invention I/O connector may be used on any portable communications device, such as pagers, PDAs, etc.

An upper casing 32 snaps together with a lower casing 34 to form a housing 36 of the I/O connector 30. Notched poles 33 on the lower casing 34 engage with corresponding holes 31 on the upper casing 32 to lock the two casings together. The housing 36 has a top opening 40, a front opening 42 and a rear opening 44. A mounting block 50 is set inside the housing 36. The mounting block 50 has a forward surface 52 and an upper surface 54. The forward surface 52 sets within the front opening 42, and has a forward opening 56, and conductor openings 51. The upper surface 54 faces the upper casing 32, and has an upper opening 58. Front ends of electrical conductors 59 protrude through the conductor openings 51, and thus protrude out of the front opening 42. The mounting block 50 is held in place on the lower casing 34 by a mounting pole 38. Additionally, notches 55 on the sides of the mounting block 50 engage with corresponding holes 35 on the upper and lower casings 32, 34. These help to both secure the mounting block 50 within the housing 36, and also to lock the two casings 32, 34 together via the mounting block 50.

A latch 60, monolithically formed of plastic, is set within the mounting block 50 inside the housing 36. The latch 60 has a first tine 62 and a second tine 64. The first and second tines 62, 64 protrude through the forward opening 56 of the mounting block 50 and through the front opening 42 of the housing 36. The second tine 64 extends farther out of the front opening 42 than the first tine 62. The first tine 62 has a notch 61 at its front end 66, and a releasing button 67 at its back end 68. The button 67 protrudes through the upper opening 58 of the mounting block 50. With this arrangement, the second tine 64 is supported by a bottom surface 53 of the forward opening 56 of the mounting block 50. The button 67, which protrudes through the top opening 40 of the housing 36, can be elastically depressed towards the second tine 64. When this is done, the notch 61 of the first tine 62 is depressed towards the second tine 64. If pressed too far, the underside of the button 67 will contact the upper surface 54 of the mounting block 50, and so cannot be depressed any farther. When the button 67 is released, the first tine 62 will spring back to its original position. Because the button 67 can be directly pressed without any other intervening structures, it is quite easy to press the notch 61 towards the second tine 64.

Finally, a cable 70 protrudes from the rear opening 44 of the housing 36. The back ends of the electrical conductors 59 are in electrical contact with the cable 70. When the I/O connector 30 is plugged into an I/O interface 83 of the cellular telephone 80, the electrical conductors 59, which protrude from the front opening 42 of the I/O connector 30, establish an electrical connection with the cellular telephone 80. Thus, the cellular telephone 80 becomes electrically connected to the cable 70.

Figure 6A:
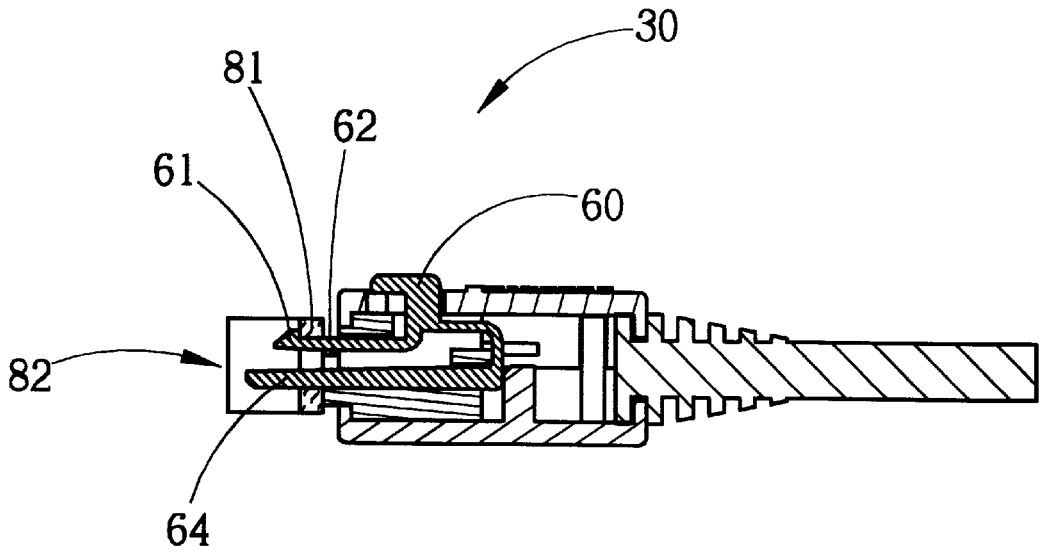
FIGS. 6A and 6B show a side view sequence diagram of the I/O connector in FIG. 5 suffering torque.
Figure 6B:
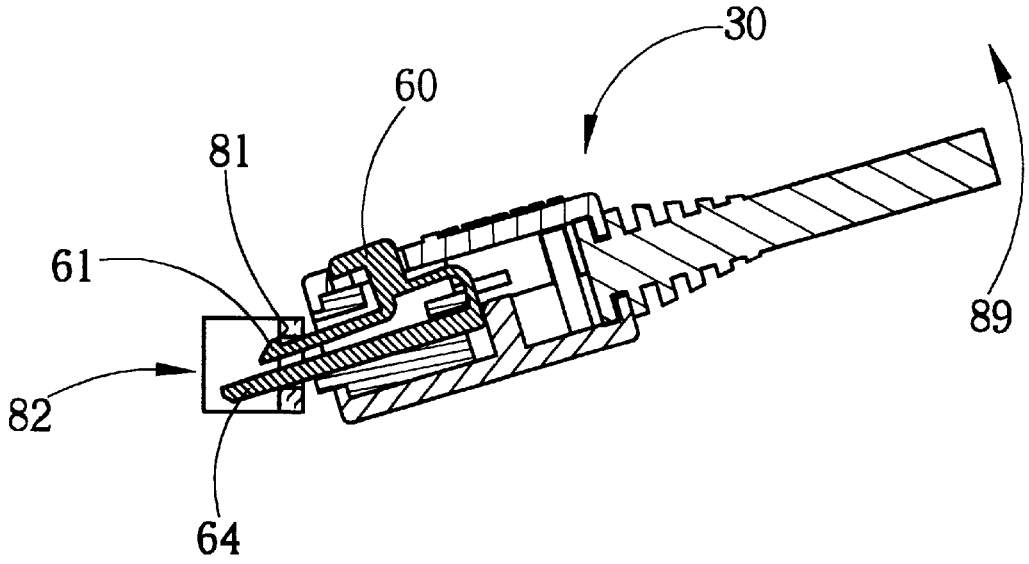

Please refer to FIGS. 6A and 6B. FIGS. 6A and 6B show a side view sequence diagram of the I/O connector 30 suffering torque 89. As shown in FIG. 6A, under no torque, the I/O connector 30 is firmly locked within a locking niche 82 of the I/O interface 83 on the cellular telephone 80. The notch 61 of the first tine 62 engages with an upper surface 81 of the locking niche 82, preventing the I/O connector 30 from being pulled away from the I/O interface 83. As shown in FIG. 6B, when the I/O connector 30 suffers torque 89, it tends to rotate about the locking niche 82. However, in doing so, the extra extension on the second tine 64 prevents the I/O connector 30 from being withdrawn from the locking niche 82. Consequently, the I/O connector 30 cannot be unintentionally disconnected from the cellular telephone 80, which creates a more secure lock between the I/O connector 30 and the I/O interface 83.

Figure 7A:
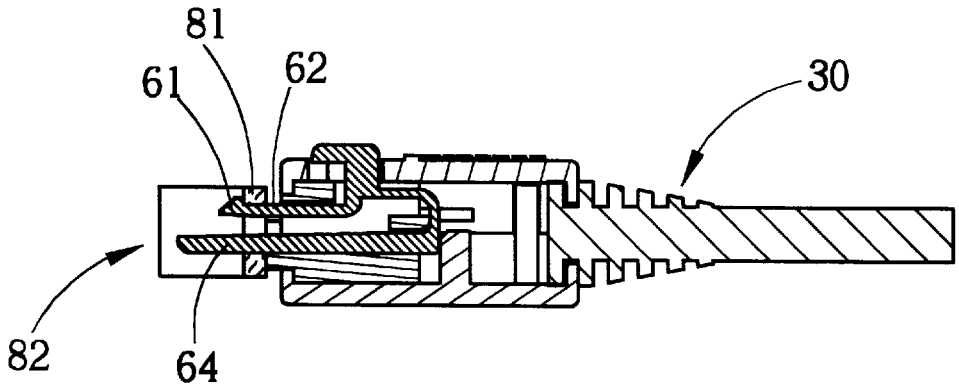
FIGS. 7A to 7C show a sequence diagram of disconnecting the I/O connector from the locking niche of the portable communications device in FIG. 5.
Figure 7B:
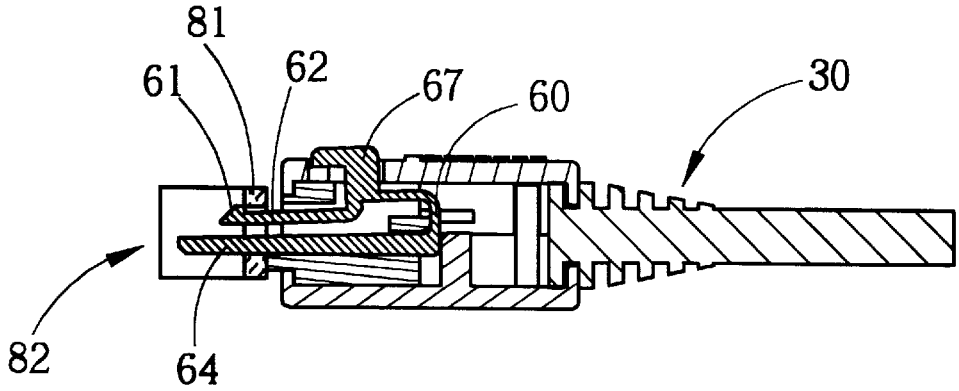
Figure 7C:
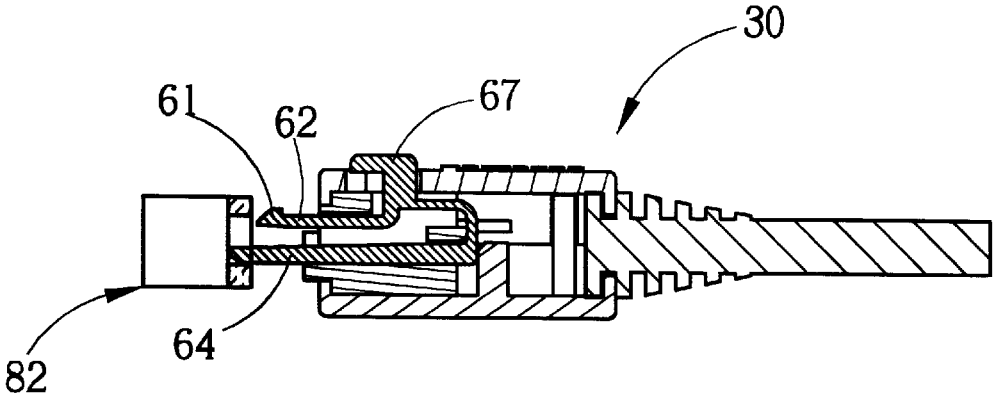

Please refer to FIGS. 7A to 7C. FIGS. 7A to 7C show a sequence diagram of disconnecting the I/O connector 30 from the locking niche 82 of the cellular telephone 80. As shown in FIG. 7A, the notch 61 of the first tine 62 engages with the upper surface 81 of the locking niche 82. In conjunction with the second tine 64, the first tine 62 keeps the I/O connector 30 securely locked within the locking niche 82. As shown in FIG. 7B, when the button 67 is depressed, the latch 60 is elastically bent, causing the notch 61 of the first tine 62 to bend towards the second tine 64. In doing so, the notch 61 disengages from the upper surface 81 of the locking niche 82. Consequently, as shown in FIG. 7C, the I/O connector 30 can be pulled back, disconnecting it from the cellular telephone 80. Thus, by pressing the button 67 towards the second tine 64, the I/O connector 30 can be unlocked from the cellular telephone 80.

In contrast to the prior art, tines of the present invention I/O connector are monolithically formed with the button that is depressed to release the I/O connector from an I/O interface. Thus, it is easier to unlock the present invention I/O connector, as less force must be exerted on the button to cause a notch on a first tine to release from a locking niche of the I/O interface. Also, a second tine of the I/O connector of the present invention is longer than the first tine, and this added length prevents the present invention I/O connector from being unintentionally released from the portable communications device.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An input/output (I/O) connector adapted to connect to a portable communications device, the I/O connector comprising:

a housing with front, rear, and top openings, the rear opening adapted to accept a cable for the I/O connector;

a monolithically formed latch located within the housing, the latch comprising:

a first tine with a notch at a front end and a releasing button at a back end; and a second tine below the first tine;

wherein by pressing on the releasing button, the front end of the first tine is elastically depressed towards the second tine; and a mounting block located within the housing, the mounting block comprising:

a forward surface with a forward opening; and an upper surface with an upper opening;

wherein the first and second tines protrude through the forward opening and the front opening, the second tine being supported by a bottom surface of the forward opening, the forward surface being located in the front opening of the housing, the releasing button of the first tine protruding through the upper opening to the top opening of the housing, a bottom surface of the releasing button coming into contact with the upper surface when the releasing button is depressed towards the second tine, the releasing button capable of being depressed through the top opening of the housing.

2. The I/O connector of claim 1 wherein the latch is made of plastic.

3. The I/O connector of claim 1 wherein at least one electrically conductive surface is electrically connected to the cable and protrudes from the front opening to establish an electrical connection with the portable communications device.

4. The I/O connector of claim 1 wherein the second tine extends farther from the front opening than the first tine to ensure a more secure lock between the I/O connector and the portable communications device.

5. The I/O connector of claim 1 wherein the tines of the latch mate with a corresponding niche in a portable communications device, and the notch of the first tine engages with the niche to lock the I/O connector inside the niche; wherein, when the releasing button is depressed towards the second tine, the notch disengages from the niche, which unlocks the I/O connector from the portable communications device.

6. An input/output (I/O) connector adapted to connect to a portable communications device, the I/O connector, comprising:

a housing with front, rear, and top openings; and a monolithically formed latch located within the housing, the latch comprising:

a first tine with a notch at a front end and a releasing button at a back end, the first tine extending from the front opening; and a second tine below the first tine, the second tine extending farther from the front opening than the first tine to ensure a more secure lock between the I/O connector and the portable communications device;

wherein by pressing on the releasing button, the front end of the first tine can be elastically depressed towards the second tine;

wherein the releasing button is capable of being depressed through the top opening of the housing, and the rear opening of the housing is adapted to accept a cable for the I/O connector.

7. The I/O connector of claim 6 further comprising a mounting block located within the housing, the mounting block comprising:

a forward surface with a forward opening; and an upper surface with an upper opening;

wherein the first and second tines protrude through the forward opening, the second tine being supported by a bottom surface of the forward opening, the forward surface being located in the front opening of the housing, and the releasing button of the first tine protruding through the upper opening to the top opening of the housing, a bottom surface of the releasing button coming into contact with the upper surface when the releasing button is depressed towards the second tine.

8. The I/O connector of claim 6 wherein the latch is made of plastic.

9. The I/O connector of claim 6 wherein at least one electrically conductive surface is electrically connected to the cable and protrudes from the front opening to establish an electrical connection with the portable communications device.

10. The I/O connector of claim 6 wherein the tines of the latch mate with a corresponding niche in the portable communications device, and the notch of the first tine engages with the niche to lock the I/O connector inside the niche; wherein, when the releasing button is depressed towards the second tine, the notch disengages from the niche, which unlocks the I/O connector from the portable communications device.

* * * * *